US006940376B2

(12) United States Patent
Morita et al.

(10) Patent No.: US 6,940,376 B2
(45) Date of Patent: Sep. 6, 2005

(54) ELECTROMAGNET AND ACTUATING MECHANISM FOR SWITCH DEVICE, USING THEREOF

(75) Inventors: Ayumu Morita, Hitachi (JP); Yasuaki Suzuki, Hitachi (JP); Masato Yabu, Hitachi (JP); Tooru Tanimizu, Hitachi (JP); Yozo Shibata, Hitachi (JP); Takashi Kadowaki, Yonago (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/854,167

(22) Filed: May 27, 2004

(65) Prior Publication Data

US 2004/0217834 A1 Nov. 4, 2004

Related U.S. Application Data

(63) Continuation of application No. 09/956,059, filed on Sep. 20, 2001, now Pat. No. 6,816,048.

(30) Foreign Application Priority Data

Jan. 18, 2001 (JP) ..... 2001-009660

(51) Int. Cl.[7] ..... H01F 7/08
(52) U.S. Cl. ..... 335/220; 335/229
(58) Field of Search ..... 335/220, 229, 335/230

(56) References Cited

U.S. PATENT DOCUMENTS

| | | | | |
|---|---|---|---|---|
| 3,794,945 A | | 2/1974 | Terracol | |
| 3,900,822 A | | 8/1975 | Hardwick et al. | |
| 4,127,835 A | * | 11/1978 | Knutson | 335/266 |
| 4,157,520 A | | 6/1979 | Moates et al. | |
| 4,166,262 A | | 8/1979 | Jencks et al. | |
| 4,403,765 A | | 9/1983 | Fisher | |
| 4,409,007 A | | 10/1983 | Torrey et al. | |
| 4,419,643 A | | 12/1983 | Ojima et al. | |
| 4,470,030 A | | 9/1984 | Myers | |
| 4,675,776 A | * | 6/1987 | Howell | 361/92 |
| 4,763,091 A | | 8/1988 | Lang | |
| 4,859,975 A | | 8/1989 | Uetsuhara | |
| 5,006,901 A | * | 4/1991 | Dick | 335/258 |
| 5,227,750 A | | 7/1993 | Connell et al. | |
| 5,268,662 A | | 12/1993 | Uetsuhara et al. | |
| 5,883,557 A | | 3/1999 | Pawlak et al. | |
| 5,959,519 A | | 9/1999 | Gobel et al. | |
| 6,404,312 B1 | | 6/2002 | Comtois et al. | |
| 6,512,435 B2 | * | 1/2003 | van Namen | 335/234 |
| 2002/0057153 A1 | | 5/2002 | Matsusaka et al. | |

FOREIGN PATENT DOCUMENTS

| | | |
|---|---|---|
| EP | 0 380 693 | 8/1990 |
| JP | 60001814 A | 1/1985 |
| JP | 01315920 A | 12/1989 |
| JP | 5-234475 | 9/1993 |
| JP | 10-505940 | 6/1998 |
| JP | 2000-249092 | 9/2000 |

* cited by examiner

*Primary Examiner*—Elvin Enad
*Assistant Examiner*—Bernard Rojas
(74) *Attorney, Agent, or Firm*—Mattingly, Stanger, Malur & Brundidge, P.C.

(57) ABSTRACT

An electromagnet includes a coil, a movable iron core adapted to move on the center axis of the coil, and a stationary iron core provided so as to cover the upper and lower surfaces and the outer peripheral surface of the coil. A permanent magnet is arranged in a gap surrounded by the movable iron core and the stationary core.

3 Claims, 13 Drawing Sheets

ELECTROMAGNET AND ACTUATING MECHANISM FOR SWITCH DEVICE, USING THEREOF

This is a continuation application of U.S. Ser. No. 09/956,059, filed Sep. 20, 2001, now U.S. Pat. No. 6,816, 048. This application is also related to Ser. No. 10/785,022.

BACKGROUND OF THE INVENTION

The present invention relates to an electromagnet and as well to an actuating mechanism using thereof for a switching device, and in particular to an electromagnet for restraining demagnetization of a permanent magnet, and as well to a reliable operating mechanism using thereof for a switching device.

RELATED ART

As to the actuating mechanism for a switching device, there have been provided an electric power driven spring actuating mechanism, and a hydraulic or pneumatic actuating mechanism. These mechanism have a large number of components so as to have a link mechanism which is complicated, resulting in a relatively high manufacturing cost. An operating mechanism using an electromagnet is used as one of measures for simplifying the link mechanism. For example, JP-A-5-234475 discloses a vacuum contactor in which an electromagnet is used for turn-on operation so that a closing spring which has been stored with energy is released simultaneously with the turn-on operation in order to open contacts. Further, in an actuating mechanism disclosed in JP-A-10-249092, a plunger is provided extending through two turn-on and -off coils so that both turn-on and turn-off are carried by electromagnet. Further, JP-A-2000-249092 discloses an actuating mechanism which maintains a turn-on condition with the use of an attraction force of a permanent magnet, and turn-off operation is carried out with the use of springs for driving movable members, which are provided respectively, by reversely energizing a coil with coil current. In this case, it is advantageous since only a single coil is required for both turn-on and turn-off.

However, the conventional electromagnet incorporating a permanent magnet has raised following disadvantages: a permanent magnet may be a rare-earth samarium cobalt group magnet, a neodymium group magnet, an alnico group magnet, a ferrite group magnet or the like. If the neodymium group magnet which has a high residual magnetic flux density and which has a relatively low cost is used, an electromagnet can be small-sized and manufactured at a relatively low cost. However, the neodymium group magnet has a high magnetic coercive force, that is, 1,000 KA/m so as to require a magnetized electric field which is higher than 2,000 KA/m (corresponding to a magnetic flux density of 2.5 T). Accordingly, it is unpractical to magnetize a permanent magnet with a coil of an incorporated electromagnet, and accordingly, a magnet has to be incorporated after being magnetized.

In the case of application of an electromagnet for a actuating mechanism for a switching device, reliable operation for a long term greater than 20 years and by a huge number of operating times are required. Accordingly, factors which cause demagnetization of a permanent magnet should be eliminated as possible as it can. An electromagnet incorporating a permanent magnet as disclosed in the JP-A-2000-249092, a backing magnetic field is applied to the permanent magnet, direct thereto so as to carry out cut-off operation. The repetition of application of reverse energy to the permanent magnet causes a risk of demagnetization of the permanent magnet or lowering of the use life thereof.

Further, if a permanent magnet is present on a magnetic path, a magnetic resistance as viewed from a coil becomes higher. Since the permeability of a permanent magnet is substantially equal to that of the air, a gap which is equal to a sum of a stroke length and the thickness of the permanent magnet is present at the time of a start of operation, and accordingly, a greater ampere turn is required.

Further, metrication errors caused during manufacture are inevitable for the thickness of the permanent magnet and the core, and the gap between the permanent magnet and the movable core which is opposed to the former and which can extend and retract, at an end of the stroke of the latter varies. Further, this gap causes the turn-on characteristic, the cut-off characteristic and the turn-on condition holding force (attraction force) to vary. However, should the allowable range for metrication errors, that is, the tolerance be strictly managed, the manufacture of an inexpensive electromagnet could be hardly be produced.

SUMMARY OF THE INVENTION

The present invention is devised in order to solve the above-mentioned problems, and an object of the present invention is to provide an electromagnet having a long use life and a high degree of efficiency, in which no backing magnetic field is applied to a permanent magnet, and further, no permanent magnet is present in a magnetic path which is created by a coil current, and as well to provided an actuating mechanism for a switching device, using the electromagnet.

Another object of the present invention is to provide an electromagnet in which the gap between the permanent magnet and the movable core which is opposed to the former and which can extend and retract can be simply adjusted.

According to the present invention, there is provided an electromagnet comprising a coil, a movable iron core which is moved on the center axis of the coil, a stationary iron core which is provided so as to cover upper, lower and outer peripheral surfaces of the coil, and a permanent magnet located in a gap defined by the movable iron core and the stationary iron core, wherein the movable core is attracted to the stationary core by a magnetic field produced by the permanent magnet.

Further, according to the present invention, there is provided an electromagnet comprising a coil, a movable iron core which is moved on the center axis of the coil, a stationary iron core which is provided so as to cover upper, lower and outer peripheral surfaces of the coil, the stationary core is provided, on such a side that the movable iron core is inserted, with a magnetic protrusion, and the movable iron core being composed of a plunger and a steel plate secured to one end part of the plunger so that an end face of the plunger and the stationary iron core, and the steel plate and the protrusion are opposed to each other in the same directions, respectively, and a permanent magnet provided in a zone which is defined by the plunger, the protrusion, the steel plate and the stationary iron core.

Further, according to the present invention, there is provided an electromagnet comprising a coil, a movable iron core which is moved on the center axis of the coil, a stationary iron core which is provided so as to cover upper, lower and outer peripheral surfaces of the coil, the stationary core is provided, on such a side that the movable iron core is inserted, with a magnetic protrusion, the movable iron core being composed of a plunger and a steel plate secured to one end part of the plunger, and a permanent magnet provided in a gap defined by the plunger, the protrusion, the steel plate and the stationary iron core, a side surface of the steel plate and the protrusion being opposed to each other, and an end face of the plunger and the stationary iron core, and the steel plate and the permanent magnet being opposed to in the same direction, respectively.

Further, according to the present invention, there is provided the electromagnet as mentioned above, which incorporates a power source circuit for selectively applying a forward or reverse current to the coil, and accordingly, when the forward current is applied, a magnetic field is produced in a direction the same as a direction of a magnetic field produced by the permanent magnet so as to effect attraction, and when the reverse current is applied, the magnetic field produced by the permanent magnet is cancelled so as to effect release action.

Further, according to the present invention, there is provided an electromagnet including a coil, a movable iron core which is moved on the center axis of the coil, a stationary core configured to cover both axially end surfaces and the outer peripheral surface of the coil, and a power source for applying a forward current and a reverse current to the coil, wherein the movable iron core is moved toward the stationary core when the forward current is applied to the coil, characterized in that the stationary iron core includes an iron core upper member configured to cover one of the axial end surfaces of the coil, a permanent magnet is located on the upper surface of the stationary iron core upper member while the movable iron core includes a planer plate member having a surface opposed to the upper surface of the stationary iron core with the permanent magnet intervening therebetween, and a plunger member having a cylindrical surface opposed to the inner peripheral surface of the coil, the inner peripheral surface of the stationary iron core upper member and the cylindrical surface of the plunger member defines therebetween a gap g1 which is smaller than the axial thickness t of the stationary core of the permanent magnet.

A magentic member may be interposed between the end surface of the plunger member on the planer plate side, and the planar plate member.

The permanent magnet may be the one selected from a group consisting of a rare earth samarium-cobalt group magnet, an alnico group magnet a ferrite group magnet.

Further, according to the present invention, there is provided an actuating mechanism for a switching device, incorporating the above-mentioned electromagnet, separatable contacts, a cut-off spring for opening the contacts, a power source circuit for selectively applying forward and reverse current to the coil wherein when the forward current is applied, the cut-off spring is urged while the contacts are turned on so as to hold the turn-on condition by attraction force of the permanent magnet, and when the reverse current is applied to the coil, a magnetic field produced by the permanent magnet is cancelled out so that the opening and closing device is cut off by a force of the cut-of spring.

That is, with the electromagnet, constituted as mentioned above, in which a magnet field causing a reverse current to run through the coil does never extend through the permanent magnet upon cut-off, the permanent magnet can be prevented from being reversely excited and further, no permanent magnet is present in a magnetic path created by coil current so that no factor of demagnetizing the permanent magnet is present, resulting in the possible use of a neodymium group magnet, thereby it is possible to provide an electromagnet having a long use life and a high degree of efficiency.

Further, by changing the thickness of a magnetic member interposed between the end surface of the plunger member on the planer plate member side, and the planer plate or changing the number of thin planar plate members which constitute the magnetic member, the gap between the permanent magnet and the movable iron core which is opposed to the former and which can extend and retract, at a stroke end, can be adjusted. That is, the characteristics thereof can be stabilized without causing the tolerance of components of the permanent magnet to be strict, thereby it is possible to provide an inexpensive electromagnet with a high degree of accuracy.

Further, with the application of the electromagnet in the actuating mechanism for a switching device, the switching device can be small-sized and inexpensive and can offer a high degree of reliability.

The present invention will be detailed in the form of preferred embodiments with reference to the accompanying drawings.

BRIEF DESCRIPTION OF THE ACCOMPANYING DRAWINGS

Figure 13:
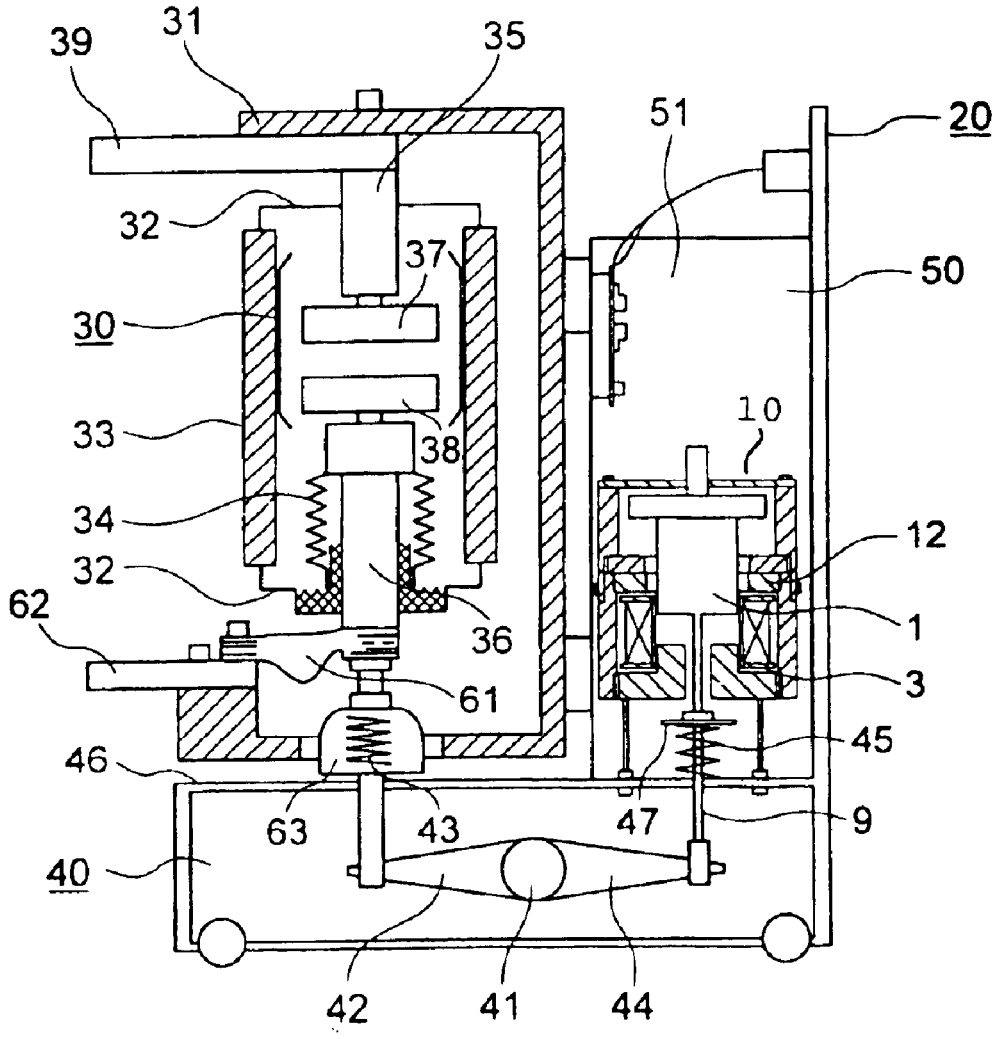
FIG. 13 is a view illustrating a structure of a vacuum switching device in which the electromagnet according to the present invention is applied.
Figure 14:
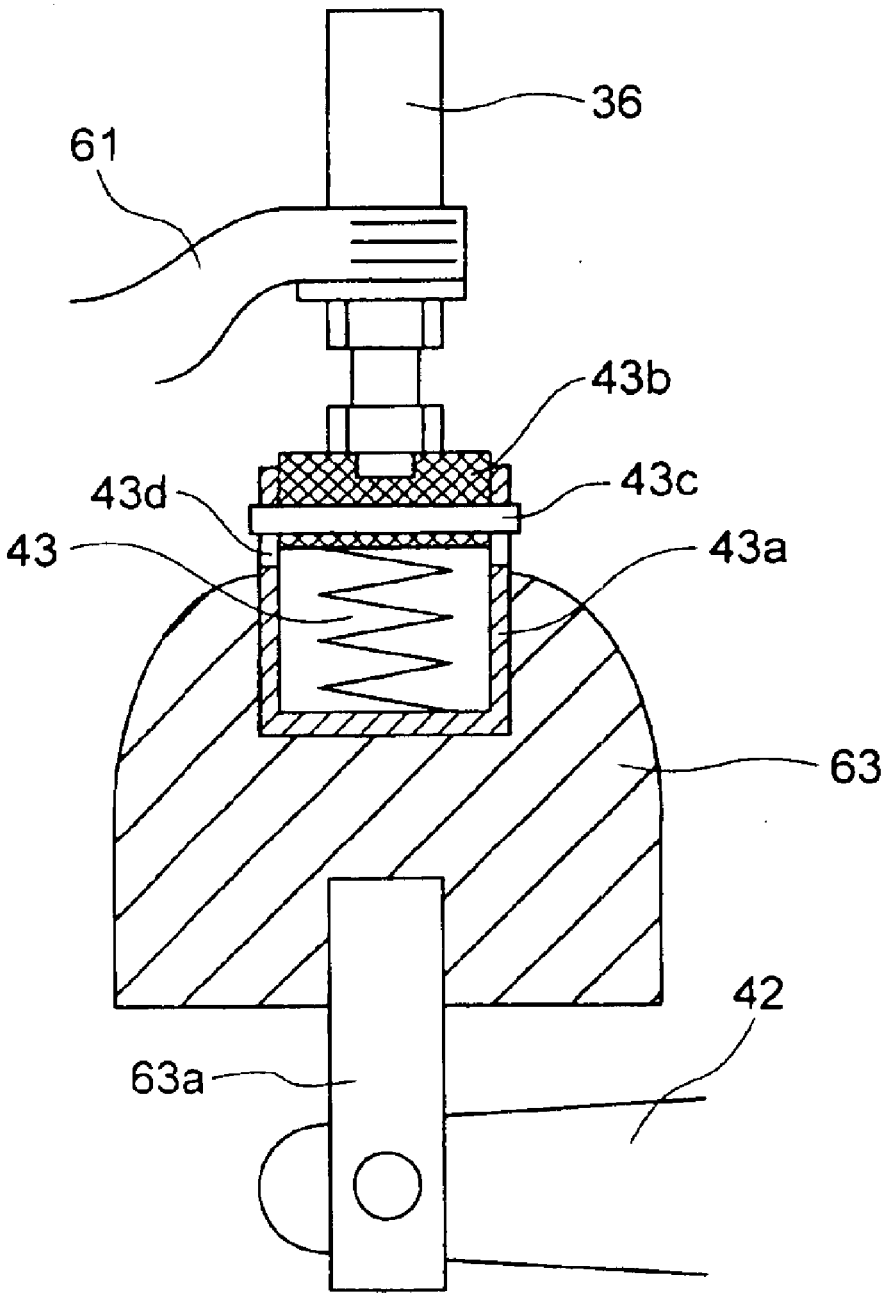
Figure 15:
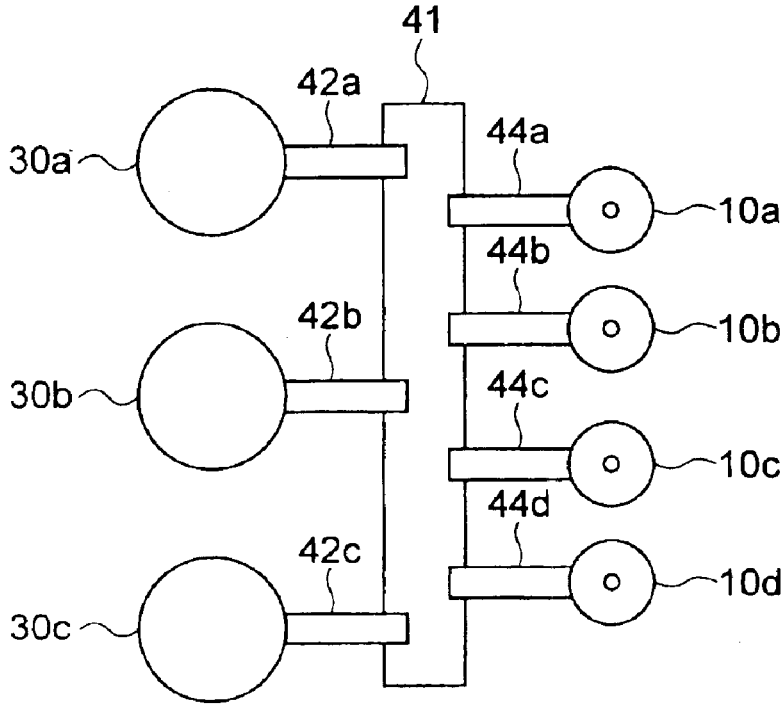
Figure 16:
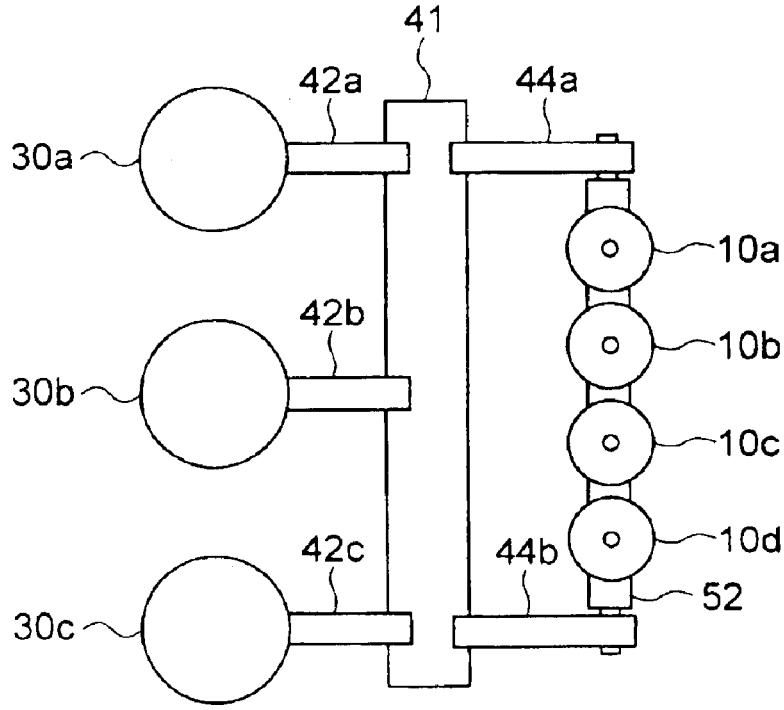

FIG. 14 is a view illustrating a structure of a peripheral part of a press-contact spring 43 in the vacuum switching device shown in FIG. 13; and FIG. 15 is a view illustrating an example of a coupling type of a plurality of electromagnets used in the vacuum switching device according to the present invention; and FIG. 16 is a view illustrating another example of the coupling system of a plurality of electromagnets incorporated in the vacuum switching device according to the present invention.

DETAILED DESCRIPTION OF PREFERRED EMBODIMENT OF THE INVENTION

Explanation will be made of preferred embodiments of the present invention with reference to FIGS. 1 to 13.

(Embodiment 1)

Explanation will be made of a first embodiment of the present invention with reference to FIGS. 1 to 5.

Figure 1:
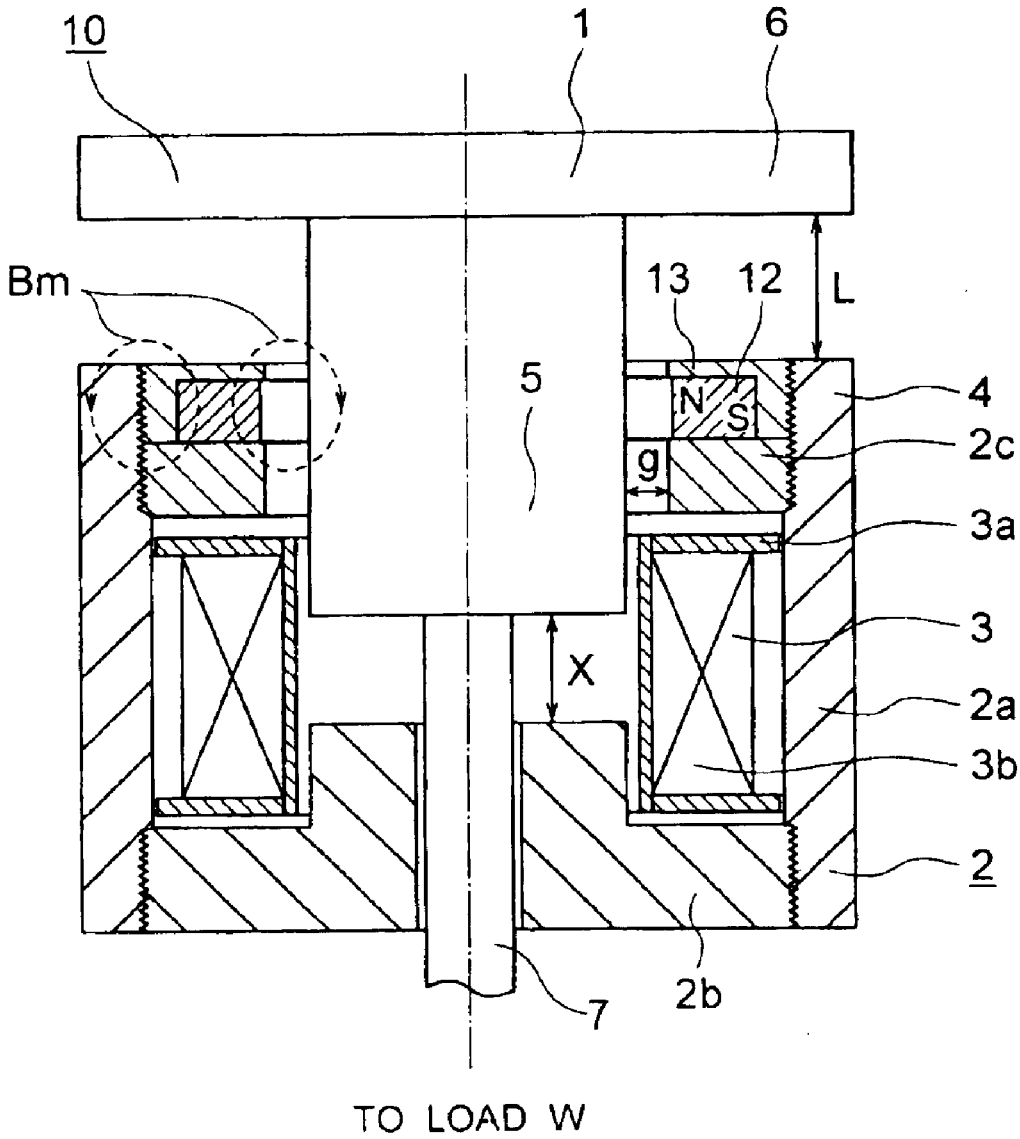
FIG. 1 is a sectional view illustrating an electromagnet in an embodiment of the present invention.

Referring to FIG. 1 which is a sectional view illustrating an electromagnet 10 in the first embodiment of the present invention, the electromagnet 10 has an axially symmetric structure. In this figure, reference numerals are attached to elements shown on the right half of the figure for explaining the structure of the electromagnet 10, and a magnetic field B (indicated by the chain line) which is effected by a permanent magnet 12 and current running through a coil 3 is shown in the left half of the figure.

A movable core 1 is composed of a plunger 5 extending through the coil on the center axis thereof, and a disc-like steel plate 6 secured to one end part of the plunger 5, and is coupled to a load W by means of a nonmagnetic coupling member 7 secured to an end part of the plunger 5. The load W effects a force which urges the movable iron core 1 upward under attraction of the electromagnet 10. A stationary iron core 2 is composed of a steel pipe 2*a*, a convex steel member 2*b* and a ring-like steel plate 2*c* which are all magnetic. The convex steel member 2*b* and the ring-like steel plate 2*c* may be attached in such a manner that they are screwed into opposite ends of the steel pipe 2*a*, as shown. Alternatively, they may be secured by welding. Further, the steel pipe 2*a* and the convex steel member 2*b*, or the steel pipe 2*a* and the ring-like steel plate 2*c* may be produced from a columnar material by cutting. Although, the convex steel member 2*b* is used in this embodiment, instead thereof, a mere planar plate may be used. However, in this case, it has been found that if a gap X between the end face of the plunger 5 and the stationary iron core 2 is present in the vicinity of the center of the coil 3, leakage fluxes can be reduced, and accordingly, the convex steel member is more preferable. Further, the convex steel member 2*b* may be formed in one unit body, or may be formed of two steel plates which are joined to each other. The coil 3 is composed of a bobbin 3*a* made of insulator or nonmagnetic metal (aluminum, copper or the like), and windings 3*b*.

The ring-like steel plate 2*c* is screwed into the steel pipe 2*a*, being relatively deep therein, and has a configuration formed with a magnetic protrusion 4. In this embodiment, the electromagnet 10 has such a configuration that the end face of the plunger 5 and the convex steel member 2*b*, and the disc-like steel plate 6 and the protrusion 4 are opposed in the same direction, respectively. The distance g between the side surface of the plunger 5 and the ring-like steel plate 2*c* is shorter than the stroke length of the movable iron core. The distance X between the end face of the plunger 5 and the convex steel member 2*b* is set to be shorter than a distance L between the disc-like steel plate 6 and the protrusion 4, and upon completion of attraction, the plunger 5 and the convex steel member 2*b* are made into contact with each other.

A ring-like permanent magnet 12 is located in a zone defined by the plunger 5, the disc-like steel plate 6, the protrusion 4 and the ring-like steel plate 2*c*, and is secured on the ring-like steel plate 2*c*. Reference numeral 13 denotes a retainer which is made of nonmagnetic material such as SUS, for the permanent magnet 12, and which is secured by being screwed into the steel pipe 2*b*. A gap is defined between the permanent magnet 12 and the protrusion 4 by the retainer 13 in order to prevent magnetic fluxes produced by the permanent magnet 12 from being short-circuited by the protrusion 4.

Figure 2:
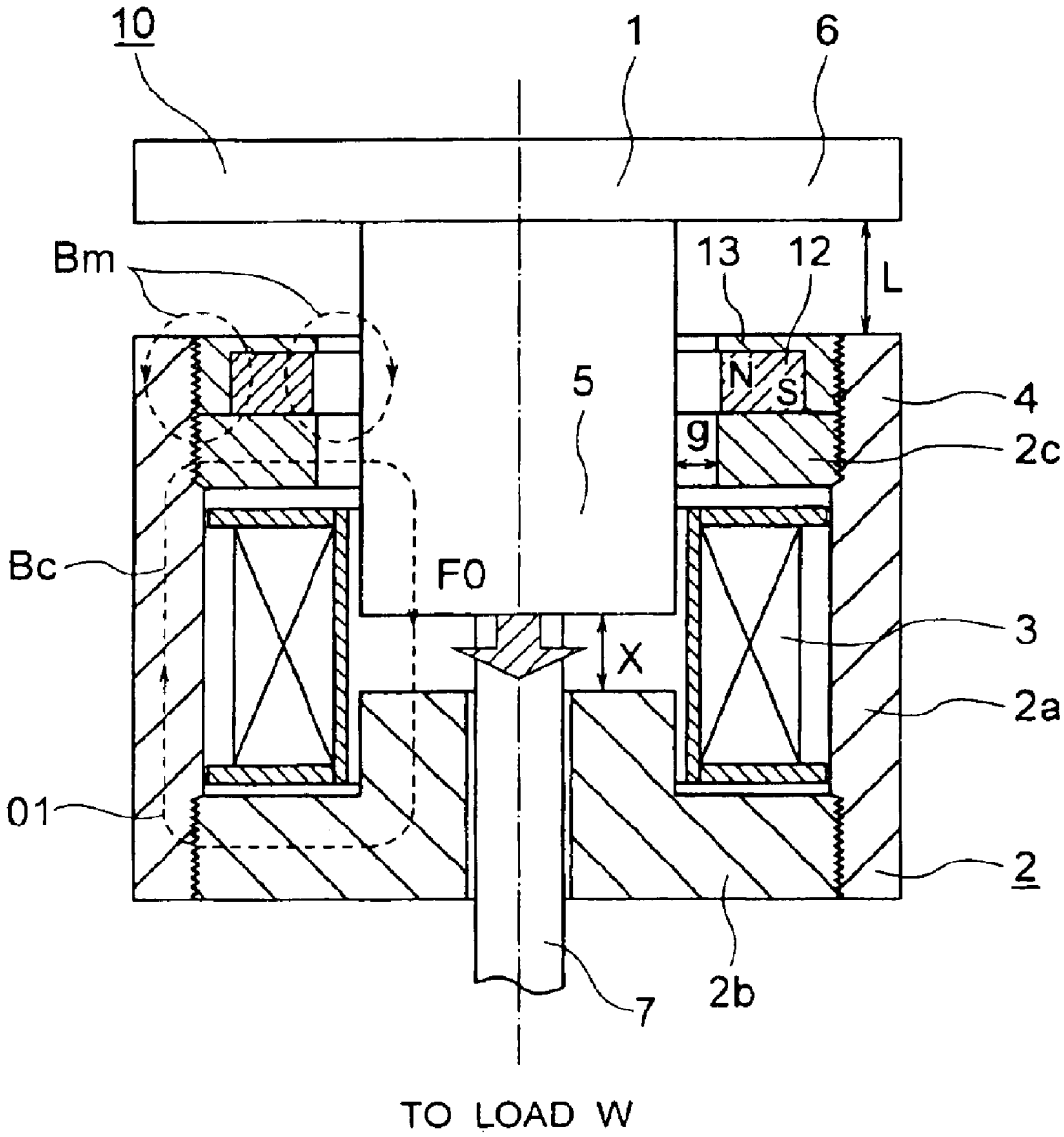
FIG. 2 is a view illustrating the electromagnet in the embodiment of the present invention in a condition just after a start of attraction thereof.
Figure 3:
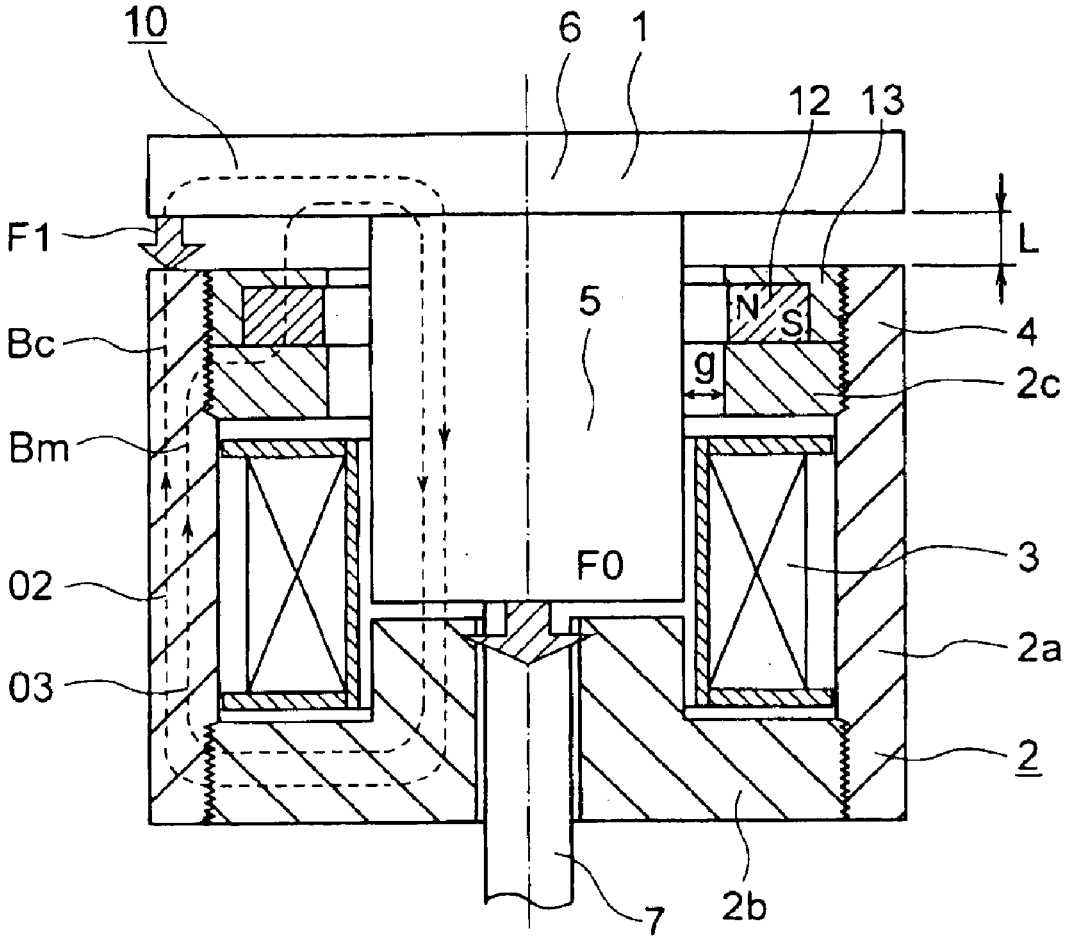
FIG. 3 is a view illustrating the electromagnet in the embodiment of the present invention in a condition just before completion of attraction thereof.
Figure 4:
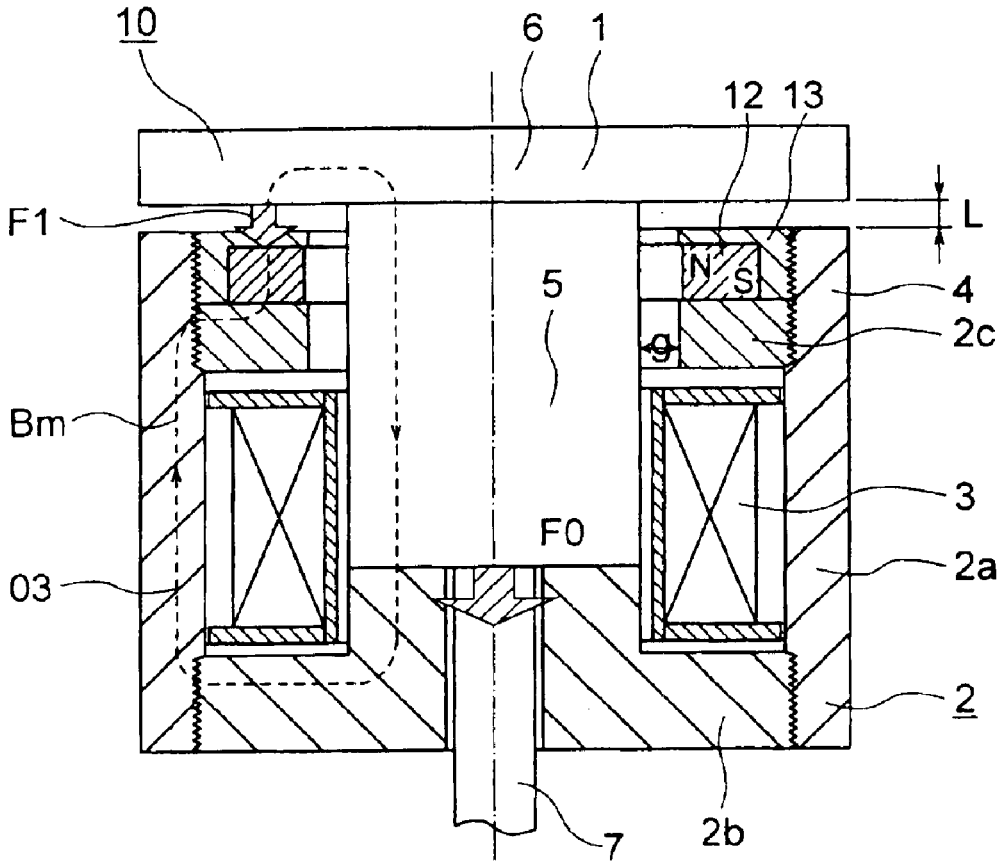
FIG. 4 is a view illustrating the electromagnet in the embodiment of the present invention in a condition in which attraction of the electromagnet is completed.
Figure 5:
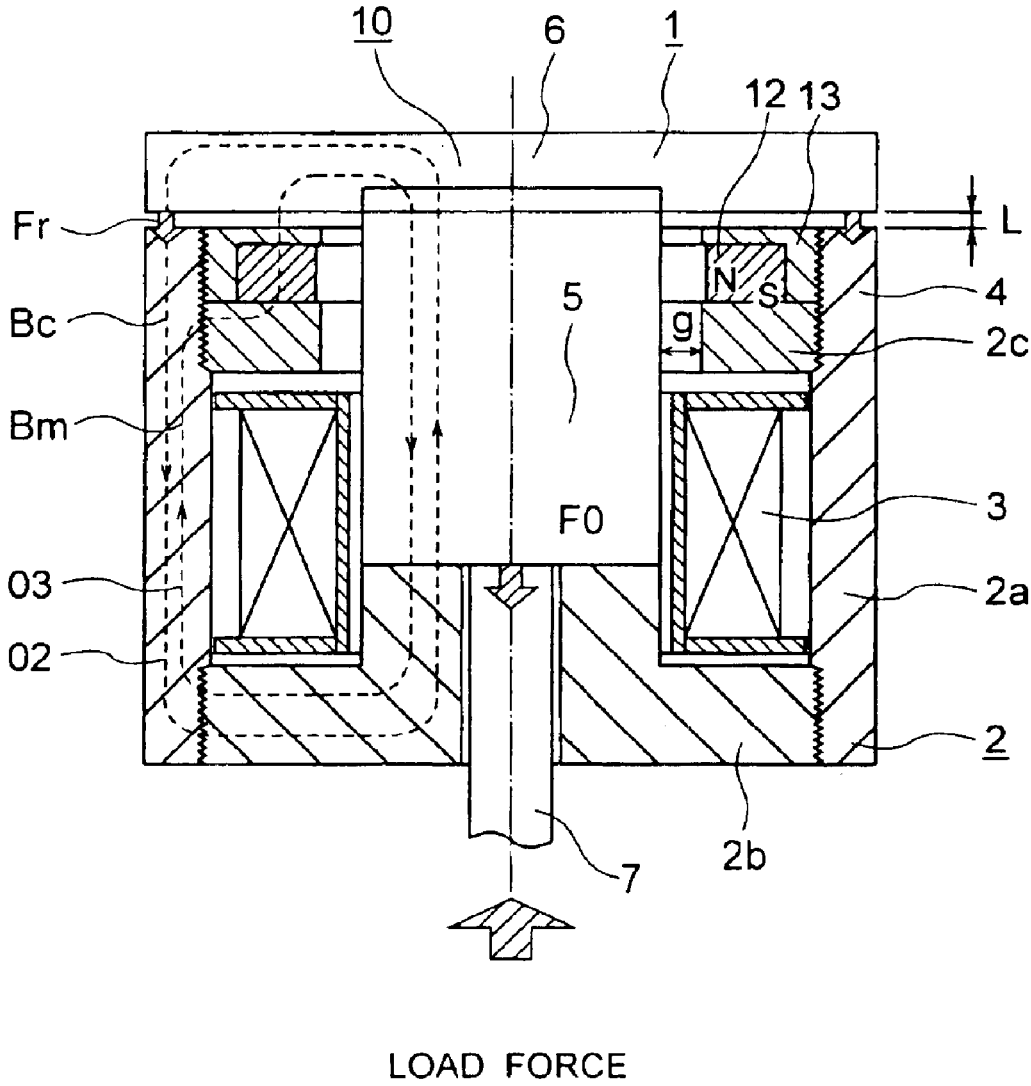
FIG. 5 is a view illustrating the electromagnet in the embodiment of the present invention in a condition in which, the electromagnet is on release operation.

Explanation will be made of the electromagnet 10 in this embodiment of the present invention with reference to FIGS. 2 to 5 in which FIG. 2 shows a condition just after a start of attraction, FIG. 3 shows a condition just before completion of attraction, FIG. 4 is a condition just after completion of attraction and FIG. 5 is a condition during release operation.

When the coil 3 is energized by an external power source circuit (which is not shown), an attraction force FO is effected at the end face of the plunger, and accordingly, the movable iron core 1 starts its downward motion. At this time, a distance g between the side surface of the plunger 5 and the ring-like steel plate 2*c* is set to be shorter than the stroke length of the movable iron core 1, a magnetic field Bc produced by a coil current passes through a magnetic path 01. It is required that the direction of the coil current and the polarity of the permanent magnet 12 have been previously set so that the magnetic field Bc and a magnetic field Bm produced by the permanent magnet 12 are extended in a direction indicated by the arrow shown in FIG. 2. It is noted that the directions of the magnetic field Bc and the magnetic field Bm may be reversed from each other, simultaneously.

When the movable iron core 1 is driven by the attraction force FO, a condition shown in FIG. 3 is effected immediately. Along with the displacement of the movable iron core 1, the gap L between the disc-like iron plate 6 and the protrusion 4 is decreased to a value which is smaller than the gap g between the plunger 5 and the ring-like steel plate 2*c* (g>L). Thus, the magnetic field Bc by the coil current branches into a magnetic path 02, and it runs through the magnetic path 02 by a substantially all amount. That is, along with the movable iron core 1, in addiction to the attraction force FO effected at the end face of the plunger 5, an attraction force F1 is effected between the disc-like steel plate 6 and the protrusion 4. It is noted that in a condition just before completion of the attraction, the magnetic field Bm of the permanent magnet 12 runs through a magnetic path 03, and accordingly, the attraction force FO is increased.

After completion of the operation of the movable iron core 1, when the current running through the coil 3 is cut off, an attracting condition is held by the attraction force of the permanent magnet 12. Even after completion of the attraction, the magnetic field Bm produced by the permanent magnet 12 passes through the magnetic path 03 since the gap is present between the disc-like steel plate 6 and the protrusion 4. Due to the attraction force FO, the attraction between the movable iron core 1 and the stationary core 2 is maintained.

Explanation will be made of release operation with reference to FIG. 5. The release operation is effected by passing a current through the coil 3 in a direction reverse to that of the current applied during the attracting operation. A magnetic field produced by this coil current runs through the magnetic path 02 so as to cancel out the magnetic field Bm produced by the permanent magnet 12. Accordingly, the attracting force FO exerted to the end face of the plunger 5 is decreased, and therefore, the movable iron core 1 is moved upward by a load force. It is noted that since an attracting force Fr is effected between the disc-like steel plate 6 and the protrusion 4 by the magnetic field Bc at the same time, should excessive current be applied to the coil 3, attracting operation would possibly be again effected. Thus, it is required to provide a means for limiting the coil current through a balance with the load force, and for cutting off the coil current at once after completion of the release operation.

Next, explanation will be made of technical effects and advantages of the present invention. As to a conventional electromagnet incorporating a permanent magnet, a permanent magnet 12 is present on a magnetic path created by coil current, and accordingly, the permanent magnet 12 is directly excited in a reverse direction during release operation. With the repetitions of application of reverse power to the permanent magnet 12, there would be a risk of demagnetization. In the electromagnet of this embodiment, the permanent magnet 12 is located in a gap defined by the movable iron core 1 and the stationary iron core 2, that is, in a zone which are magnetically shielded, and according, the magnetic field Bc produced by the coil current can be prevented from acting directly upon the permanent magnet 12. Even during the release operation, reverse power is never applied to the permanent magnet 12. There by it is possible to provide a magnetic disc 12 which can eliminate the risk of demagnetization, and which can have a long use life and a high degree of the magnet.

Further, the magnetic permeability of the permanent magnet 12 is substantially equal to that of the air, and if the permanent magnet 1 is present in the magnetic path created by the coil current, the magnetic resistance as viewed from the coil becomes higher. Upon a start of the operation, a gap which is the sum of the stroke and the thickness of the permanent magnet 12 is present, and accordingly, the ampere turn required for the operation is increased. However, since no permanent magnet is present on the magnetic path created by the coil current in the electromagnet 10 according to this embodiment, the magnetic resistance is low, and accordingly, the efficiency becomes higher.

(Embodiment 2)

Explanation will be made of a second embodiment with reference to FIGS. 6 and 7.

Figure 6:
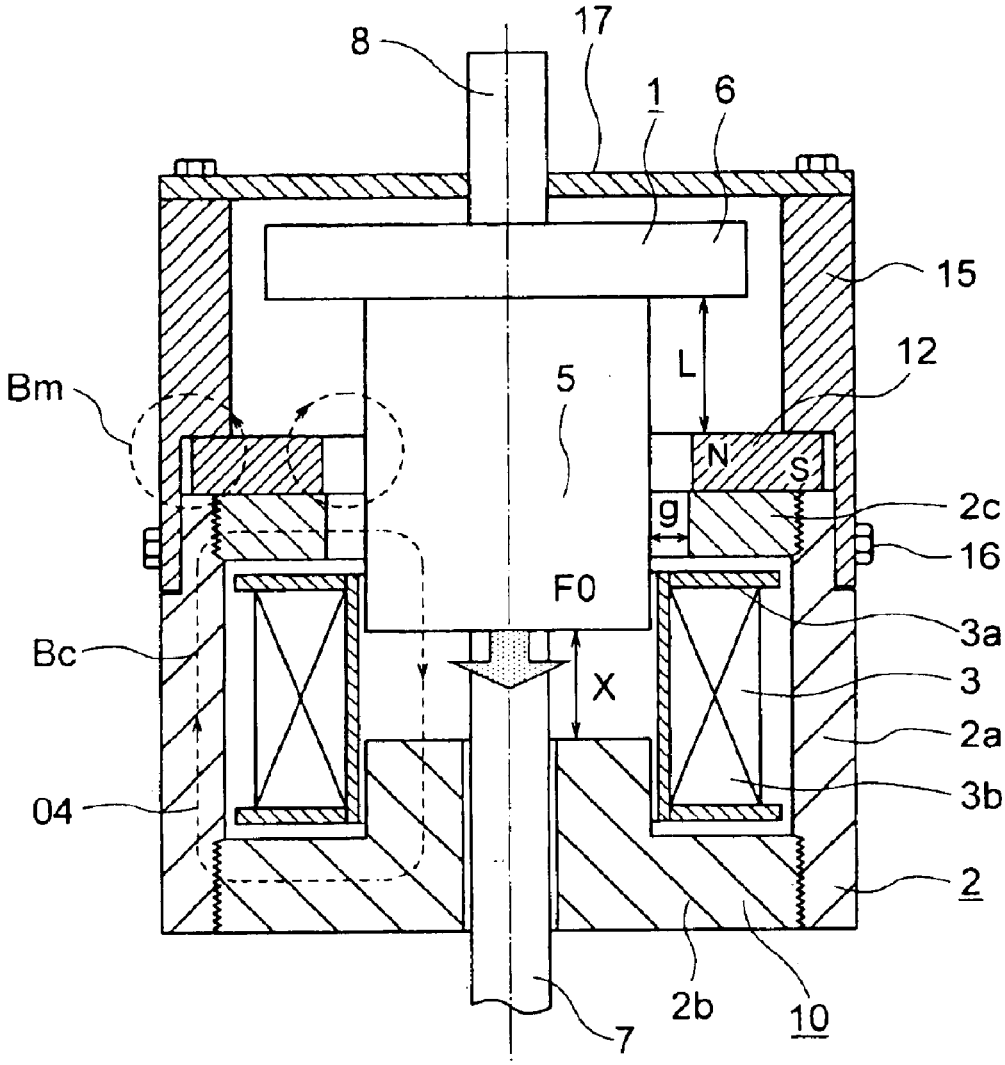
FIG. 6 is a view illustrating an electromagnet in a second embodiment of the present invention in a condition just after a start of attraction of the electromagnet.

FIG. 6 is a sectional view illustrating an electromagnet 10 in a second embodiment of the present invention. A movable iron core 1 is composed of a plunger 5 extending through a coil 3 along the center axis of the latter, and a disc-like steel plate 6 secured to one end part of the plunger, and is coupled to a load through the intermediary of a nonmagnetic coupling member 7 secured to the other end part of the plunger 5. A stationary iron core 2 is composed of a steel pipe 2*a*, a convex steel member 2*b* and a ring-like steel plate 2*c* which are all magnetic. The convex steel member 2*b* and the ring-like steel plate 2*c* may be attached to the opposite ends of the steel pipe 2*a*, being screwed thereinto. Alternatively, they may be secured thereto by welding. The convex steel member 2*b* may be manufactured in one unit body, but it may be formed of two steel plates connected to each other. The coil 3 is composed of a bobbin 3*a* made of an insulator or a nonmagnetic metal (aluminum, copper or the like), and windings 3*b*.

The ring-like permanent magnet 12 is secured on the ring-like steel plate 2*c*. It is noted that reference numeral 15 denotes a pipe made of a non-magnetic material such as SUS, and is fixed to the steel pipe 2*a*, the permanent magnet 12 being interposed therebetween. Since no large force is exerted to the pipe 15, it may be fixed by means of screws. The reason why the pipe 15 is made of a nonmagnetic material is such that the magnetic field of the permanent magnet 12 should be prevented from short-circuited by the pipe 15. Further, a lid 17 made of a nonmagnetic material is attached to one end part of the pipe 15, and a rod 8 secured to the movable core 1 extend thererthrough. Thus, axial deviation of the movable iron core 1 is prevented by the lid 17, the convex steel member 2*b*, the coupling member 7 and the rod 8.

The distance X between the end face of the plunger 5 and the convex steel pipe 2*b* is shorter than the distance L between the disc-like steel plate 6 and the permanent magnet 12 in order to prevent the disc-like steel plate 6 from impinging upon the permanent magnet 12 so as to damage the latter.

Explanation will be made of the operation of the electromagnet 10 in this embodiment with reference to FIGS. 6 to 8 which are sectional views illustrating the electromagnet 10, reference numerals for explaining the structure thereof being indicated in the right side part of the figure while a configuration of magnetic fields is shown in the left side part thereof.

FIG. 6 shows a condition just after a start of attraction. Both distance X between the end face of the plunger 5 and the convex steel member 2*b* and distance L between the disc-like steel plate 6 and the permanent magnet 12 are longer than a distance g between the permanent magnet 12 and the plunger 5, and the magnetic field Bm created by the permanent magnet 12 only affects upon a part around the permanent magnet 12 as shown in FIG. 6. Thus, a drive force exerted to the movable iron core 1 is extremely small. When the coil 3 is energized by an external power source (which is not shown), the magnetic field Bc created by the coil current exerts an attracting force FO to the end face of the plunger 5, and accordingly, the movable iron core 1 starts its downward movement. Since the distance g between the side surface of the plunger 5 and the ring-like steel plate 2*c* is set to be longer than the length of stroke of the movable iron core 1, the magnetic flux Φc created by the coil current passes through a magnetic path 04. It is required to previously set the direction of the coil current and the direction of the polarity of the permanent magnet 12 so as to extend the magnetic field Bc created by the coil current and the magnetic field Bm of the permanent magnet Bm in a direction indicated by the arrow shown in FIG. 6. It is noted that the direction of the magnetic field Bc and the direction of the magnetic field Bm may be reversed from each other at the same time.

Figure 7:
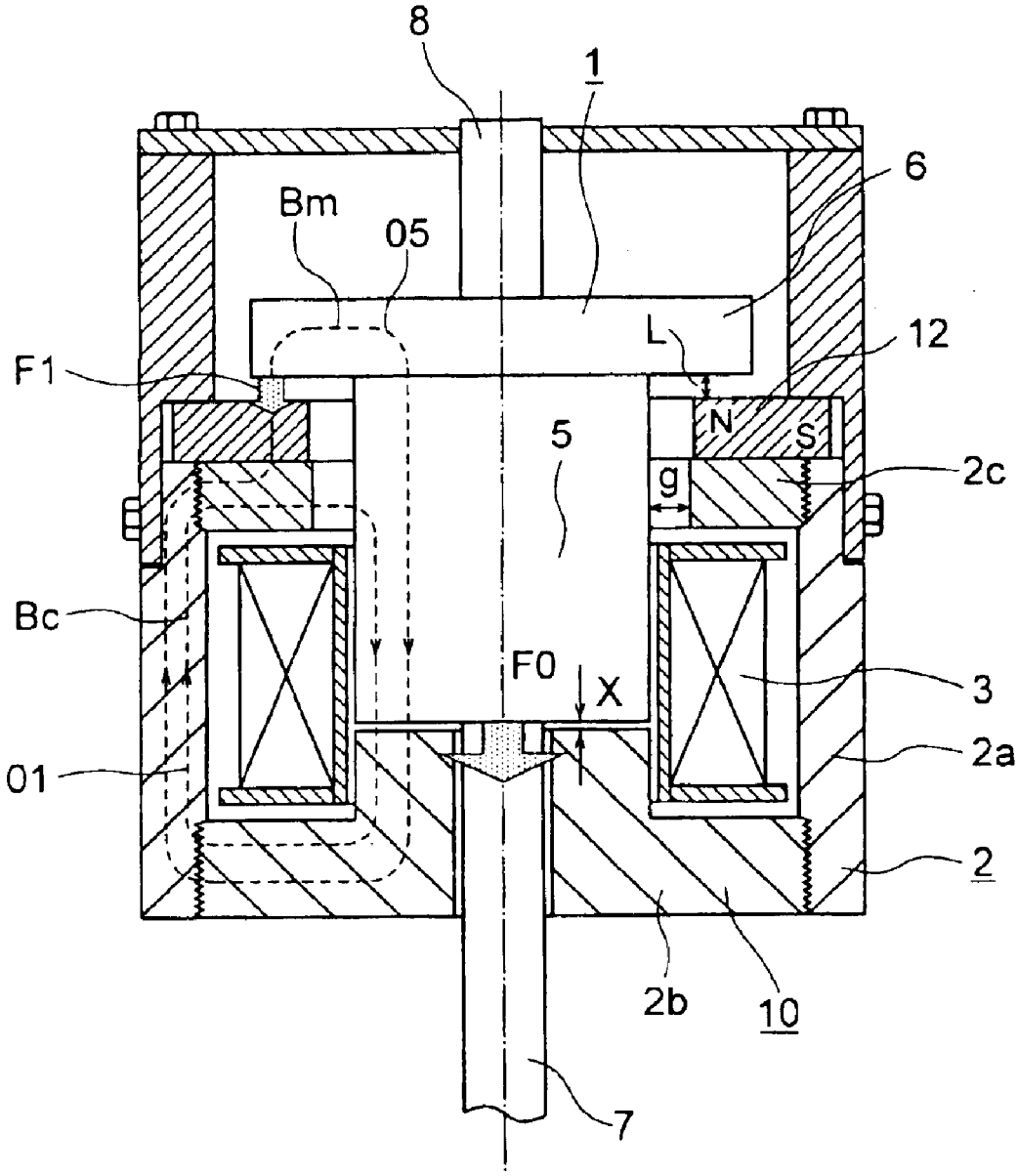
FIG. 7 is a view illustrating the electromagnet in the second embodiment of the present invention in a condition just before the completion of attraction thereof.

When the movable iron core 1 is driven by the attracting force FO, a condition shown in FIG. 7 is immediately effected. Along with the movement of the movable iron core 1, the gap L between the disc-like steel plate 6 and the permanent magnet 12 is decreased so as to be shorter than the gap g between the plunger 5 and the ring-like steel plate 2*c* (g>L), and accordingly, the magnetic field Bm of the permanent magnet 12 passes through a magnetic path 05. That is, as the movable iron core 1 advances, the attracting force FO is exerted to the end face of the plunger 5, and an attracting force F1 is also effected between the disc-like steel plate 6 and the permanent magnet 12. Further, the electromagnet Bm of the permanent magnet 12 passes through opposed surfaces of the plunger 5 and the convex steel member 2*b*, and accordingly, the attracting force FO becomes further larger.

After completion of the iron core 1, when the coil 3 is deenergized, the attracting force FO and the attracting force F1 are effected by the magnetic flux Φm of the permanent magnet 12, and this condition is maintained.

Figure 8:
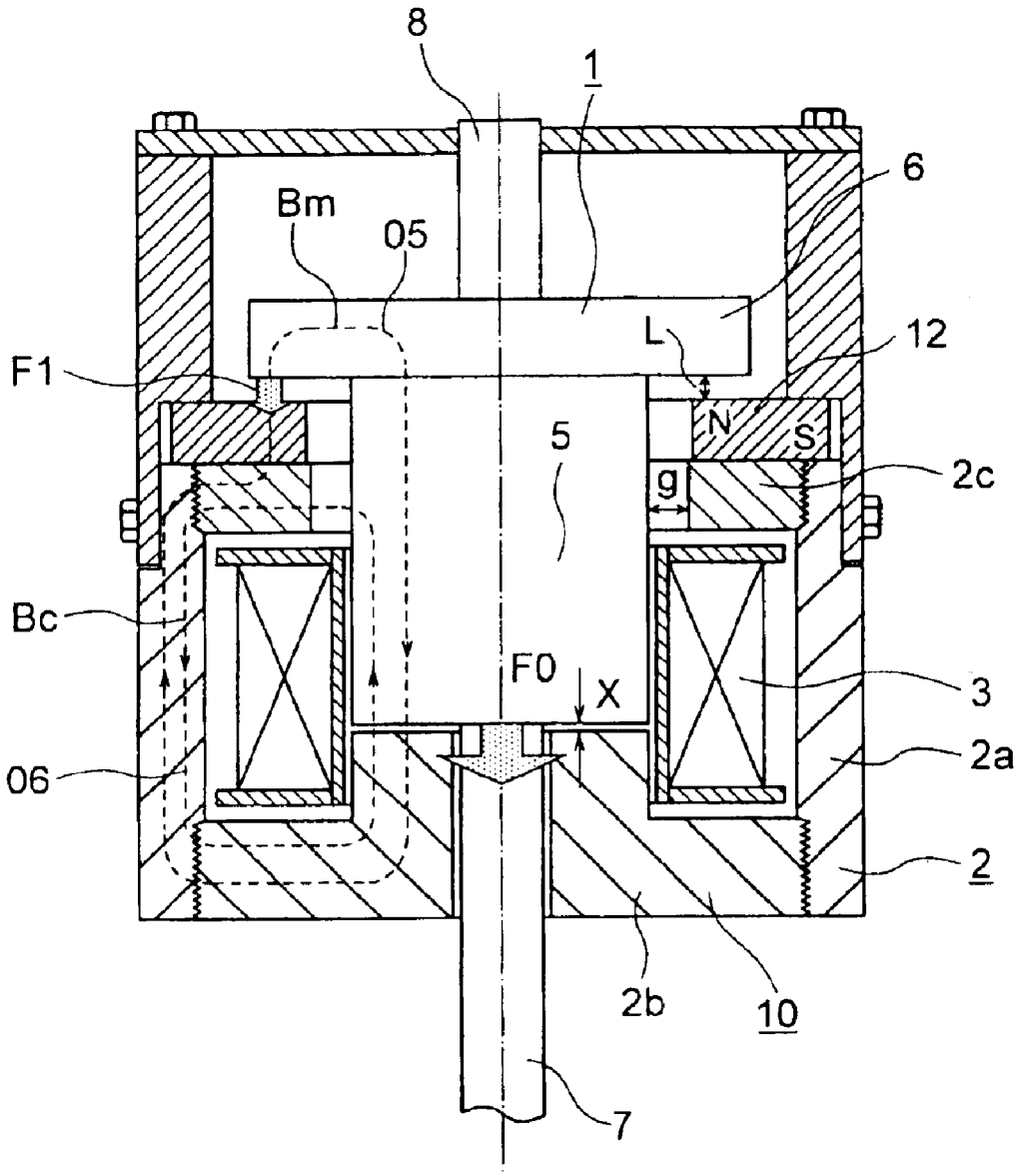
FIG. 8 is a view illustrating the electromagnet in the second embodiment of the present invention in a condition in which the electromagnet is on release operation.

Meanwhile, the release operation is carried out by energizing the coil 3 with a current in a direction reverse to that during attraction, as shown in FIG. 8. The magnetic field Bc created by the coil current runs through a magnetic path 06 so as to cancel out the magnetic field Bm created by the permanent magnet 12, the attraction force FO is decreased, and accordingly, the movable iron core 1 is moved upward by the load force.

Explanation will be made of technical effects and advantages obtained in this embodiment. Similar to the electromagnet in the embodiment 1, the magnetic field created by the coil current does not directly affect upon the permanent magnet 12, and accordingly, no reverse energy is exerted even during release operation. Thus, a risk of demagnetization of the permanent magnet 12 can be avoided, and therefore, the electromagnet can have a long use life and a high degree of reliability. Further, the permeability of the permanent magnet 12 is substantially equal to that of the air, and accordingly, should the permanent magnet 12 be present in the magnetic path created by the coil current, the magnetic resistance as viewed from the coil would become higher. Upon a start of operation, a gap which is the sum of the stroke and the thickness of the permanent magnet 12 is present, resulting in an increase in required ampere turn. In the electromagnet 10 in this embodiment, no permanent magnet is present in the magnetic path created by the coil current, the magnetic resistance becomes lower, and accordingly, the efficiency becomes higher.

Further, the electromagnet in this embodiment can offer the following technical effects and advantages. In the electromagnet in the first embodiment causes such a problem that attraction is again effected during release operation if excessive current is applied to the coil 3 since the attracting force F1 is effected between the disc-like steel plate 6 and the magnetic protrusion 4 by the magnetic field Bc created by the coil current. Thus, it is required to provide a measure for limiting the coil current through the balance with the load force, and cutting off the coil current just after completion of release operation. However, there is no part where an attracting force is produced by the magnetic field Bc by the coil current in the electromagnet in this embodiment, and accordingly, it is not required to provide a measure for limiting the coil current through the balance with the load force, and cutting off the coil current just after the completion of release operation.

(Embodiment 3)

Figure 9:
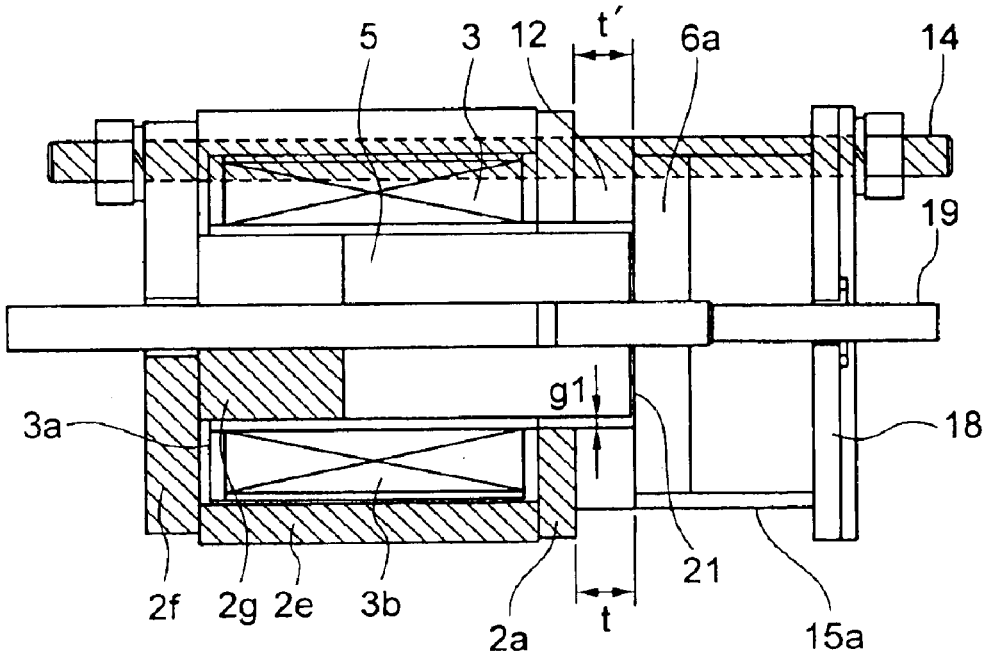
FIG. 9 is a view illustrating an electromagnet in a third embodiment, in a turn-on condition.
Figure 10:
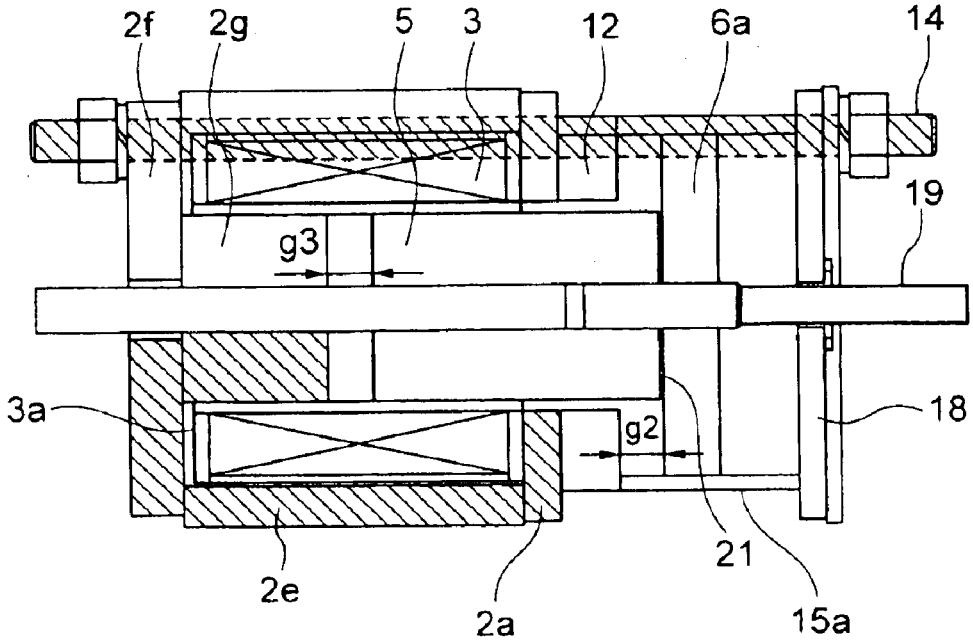
FIG. 10 is a view illustrating the electromagnet in the third embodiment, in a turn-off condition.

Explanation will be hereinbelow made of a third embodiment of the present invention with reference to FIGS. 9 (in a turn-on condition) and 10 (in a turn-off condition). FIGS. 9 and 10 are sectional views illustrating an electromagnet 10 in this embodiment, when a switching device which is coupled to the electromagnet is turned on (FIG. 9) and when the switching device which is coupled to the electromagnet is turned off (FIG. 10), respectively. The turn-on condition and the turn-off condition, which will be taken in the following description, are conditions of the electromagnet obtained when the switching device which is coupled to the electromagnet is turned on and off, respectively.

The coil 3 is composed of a bobbin 3*a* made of an insulator or nonmagnetic metal (aluminum, copper or the like), and windings 3*b*.

The electromagnet 10 as shown is composed of the coil 3, a movable iron core adapted to be moved on the center axis of the coil 3 and made of a magnetic material, a stationary iron core configured to cover axially opposite end surfaces and the outer peripheral surface of the coil 3 and made of a magnetic material, a power source which is not shown, for applying a forward current and a reverse current to the coil. When the coil is applied thereto with a forward current, the movable iron core is moved in a direction toward the stationary iron core, that is, in a direction from the right to the left as viewed in the figure. It is noted that the right and the left sides of FIG. 9 correspond respectively to the upper and lower sides in view of the direction of the movement of the movable iron core.

The stationary iron core is composed of a square planar plate 2*a* which is a stationary iron core upper member configured to cover one of the opposite end surface of the coil 3, and which is formed in its center part with a circular opening concentric with the coil 3, a square planar plate 2*f* which is a stationary iron core lower member configured to cover the other of the opposite end surfaces of the coil, and which is formed in its center part with a circular opening concentric with the coil 3, and a steel pipe 2*e* which is held between the two square planar plates 2*a*, 2*f* and which covers the outer peripheral surface of the coil 3, a cylinder 2*g* which arranged on the upper surface of the square planar plate 2*f*, concentric with the steel pipe 2*e*. The square planar plate 2*a*, the square planar plate 2*f*, the steel pipe 2*e*, and the cylinder 2*g* are all made of magnetic materials. The square planar plate 2*f* and the cylinder 2*g* are fixed together by screws, but may be welded together. Further, they may, of course, be integrally formed by cutting one and the same material.

A disc-like permanent magnet 12 formed at its center with a circular opening is arranged on the square planar plate 2*a*, being attracted thereto, and is secured thereto with an adhesive. The permanent magnet 12 may be made of any one of a material of a neodymium group, a samarium group, an alnico group, a neodymium bond group and a ferrite group. Further, although the permanent magnet 12 as shown is a single ring magnet, it should not be in an integral ring-like shape, but planar magnets having different shapes such a rectangular shape, a circular shape or the like may be distributed on the square planar plate 2*a*. However, even in this case, it is required to set the areas of the surfaces of the magnets opposed to a cylindrical planar plate 6*a* which will be detailed later so as to effect a required attracting force.

The movable iron core is composed of a nonmagnetic rod 19 piercing through the opening of the square planar plate 2*a*, the opening of the square planar plate 2*f*, the steel pipe 2*e* and the cylinder 2*g* at their centers, a magnetic cylindrical plunger 5 fitted on and fixed to the rod 19, and the magnetic cylindrical planar plate 6*a* which is arranged on the upper side of the plunger 5 through the intermediary of a thin plate 21 which is a magnetic member and which is fixed to the rod 19. The lower surface of the cylindrical planar plate 6*a* is opposed to the upper surface of the square planar plate 2*a* with the permanent magnet 12 intervening therebetween, and the outer peripheral surface of the plunger 5 is opposed to the inner peripheral surface of the coil 3. That is, the outer diameter of the plunger 5 is smaller than any of the inner diameter of the coil 3, the diameter of the center opening of the permanent magnet 12 and the diameter of the center opening of the square planar plate 2*a*, and accordingly, it can axially move therethrough. However, the outer diameter of the cylindrical planar plate 6*a* is larger than the diameter of the center opening of the permanent magnet 12, and accordingly, it can not pass through the center opening of the permanent magnet 12. Further, the plunger 5 and the cylindrical planar plate 6*a* are secured to the rod 19, threadedly or by means of a retainer.

Further, the center opening of the permanent magnet 12 and the center opening of the square planar plate 2*a* are concentric with each other and have an equal diameter. Further, the thickness t of the permanent magnet 12 is set to be larger than the gap g1 between the inner peripheral surface of the center opening of the square planar plate 2*a* and the outer peripheral surface of the plunger 5.

The outer diameter of cylinder 2*g* is smaller than the inner diameter of the coil 3, and is set to be equal to the outer diameter of the plunger 5. Further, the inner diameter of the cylinder 2*g* is set so as to allow the rod 19 to freely pass therethrough. That is, the lower surface of the plunger 5 is opposed to the upper surface of the cylinder 2*g*, and accordingly, when the movable iron core is axially moved leftward, the movable limit thereof is determined by a point where the lower surface of the plunger 5 comes into contact with the upper surface of the cylinder 2*g*.

A nonmagnetic pipe 15*a* (which is made of stainless steel in this embodiment) is arranged on the upper side of the permanent magnet 12, concentric with the coil 3, and is held between the permanent magnet 12 and a square planer plate 18 which may be made of magnetic or nonmagnetic materials. Holes are formed in the four corners or two diagonal corners of the square planar plate 2*f*, the square planar plate 2*a* and the square planar plate 18. The holes can receive therethrough rods 14 having their opposite end parts formed with threads. By fastening the opposite end parts of the rods 14 with nuts, there are all fixed together.

The square planar plate 18 and the square planar plate 2*f* are formed therein with bores which are concentric with the coil, and through which the rod 19 can pass, and these bores are fitted therein with bearings such as dry bearings so as to reduce the friction with respect to the rod 19 sliding therethrough, thereby it is possible to save maintenance works.

Referring to FIG. 9 which shows the turn-on condition of the electromagnet, the holding condition is effected by the attraction force (produced by a magnetic flux Φ1). That is, in the turn-on condition, the gap g3 between the lower surface of the plunger 5 and the upper surface of the cylinder 2*g* is held to be zero, that is, the lower surface of the plunger 5 and the upper surface of the cylinder 2*g* are held so as to be made into contact with each other. Instead of direct contact between the lower surface of the plunger 5 and the upper surface of the cylinder 2*g*, a thin nonmagnetic material may be held therebetween.

During assembly of the electromagnet, the number of thin plates 21 to be held between the plunger 5 and the cylindrical planar plate 6*a*, which have been previously prepared and which have an equal thickness, is changed in order to adjust the size of the gap g2 between the permanent magnet 12 and the cylindrical planar plate 6*a* to a desired value. The reason why the gap g2 is required, is such that, when the cylindrical planar plate 6*a* bumps directly upon the permanent magnet 12 during turn-on operation, the permanent magnet 12 is demagnetized, causing the use life of the permanent magnet 12 to be shortened.

Further, by changing the number of thin plates 21, the gap g2 is decreased to a small value which is possibly zero so as to decrease the magnetic resistance in order to increase the attraction force. As a result, even though the permanent magnet 12 is thinned, or even though the bulk of the permanent magnet 12 is reduced by decreasing its outer surface for attracting the square planar plate 2*a*, a conventional attracting force can be ensured. Thus, the cost of the permanent magnet 12, which greatly depends upon the bulk of the permanent magnet, can be reduced, thereby it is possible to provide a small-sized and inexpensive electromagnet. Further, by changing the number of thin plates 21, the gap $g^2$ in a turn-on condition can be set to a nearly desired constant value, the attraction force and the turn-on and -off characteristics of the permanent magnet can be stabilized, thereby it is possible to enhance the reliability of the permanent magnet.

It is noted that, instead of changing the number of thin plates having an equal thickness so as to adjust the value of the gap, plates having slightly different thickness, which have been previously prepared are used by selecting an appropriate thickness, singularly or in combination in order to adjust the above-mentioned gap.

Next explanation will be made of turn-on and -off operation with reference to FIG. 11 (turn-on operation) and FIG. 12 (turn-off condition).

Figure 11:
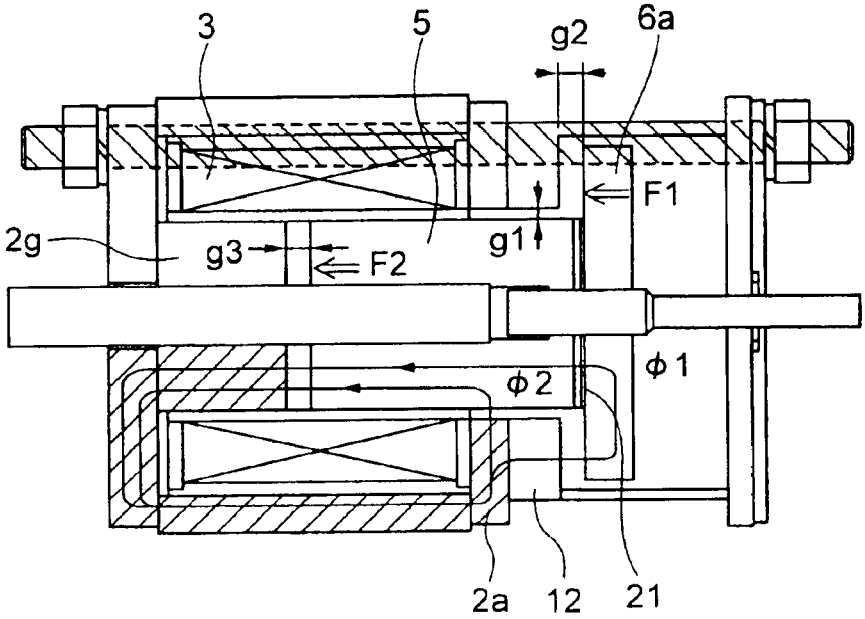
FIG. 11 is a view illustrating the electromagnet in the third embodiment in the third embodiment during turn-on operation.

During the turn-on operation shown in FIG. 11, a current (forward current) is applied from the power source which is not shown to the coil 3 so that the coil produces a magnetic field in the same direction as that effected by the permanent magnet 12. That is, the coil current and the permanent magnet 12 produce magnetic fluxes Φ1, Φ2 as shown in FIG. 11 so as to produce an attracting force for moving the cylindrical planar plate 6*a* leftward in the figure, that is, a force for attracting the movable iron core to the stationary core. This attraction force is produced both gaps between the plunger 5 and the cylinder 2*g* and between the cylindrical plate 6*a* and the permanent magnet 12. That is, the force F1 is effected between the cylindrical plate 6*a* and the permanent magnet 12, and the force F2 is effected between the plunger 12 and the cylinder 2*g*. The force F2 during turn-on operation is produced by a magnetic flux obtained by synthesizing the magnetic flux Φ2 and Φ1.

Figure 12:
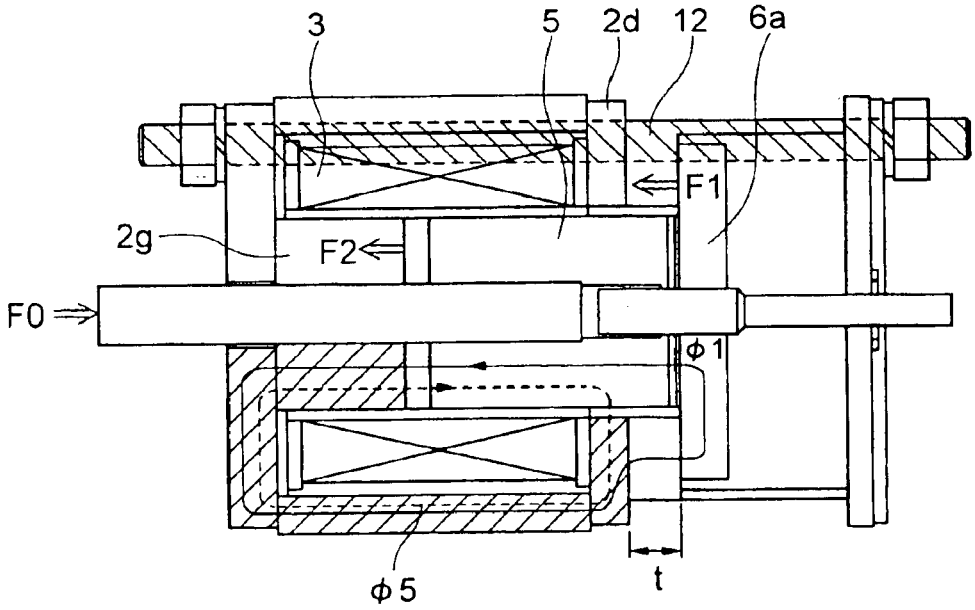
FIG. 12 is a view illustrating the electromagnet in the third embodiment in the third embodiment during turn-off operation.

During the turn-off operation shown in FIG. 12, a current reverse to the current during turn-on operation, is applied to the coil 3 from the power source which is not shown. During the turn-on operation, the sum of the force F1 produced in the gap between the cylindrical plate 6*a* and the permanent magnet 12 by the magnetic flux Φ1 and the force F2 produced in the gap between the plunger 5 and the cylinder 2*g* by the magnetic flux Φ1 is greater than a force FO which is applied to the rod 19 in the rightward direction in the figure, by a cut-off spring which is not shown. That is, the force of the permanent magnet 12 overcomes the force of the cut-off spring, and accordingly, the turn-on condition is held. In this condition, when the reverse current is applied to the coil 3, a magnetic flux Φ5 is produced in a direction reverse to that of the magnetic flux Φ1, and accordingly, the magnetic flux Φ1 is weakened by the magnetic flux Φ5. This weakened magnetic flux (or the magnetic flux Φ1 and the magnetic flux Φ5 in the reverse direction) produces a force. F2*b* in the gap between the plunger 5 and the cylinder 2*g*. Since F2*a*>F2*b*, the force applied to the movable iron core leftward as viewed in the figure becomes small, that is, F0>(F1+F2), the turn-off operation is started.

At this time, since the thickness t of the permanent magnet 12 is set to be greater than the gap g1 between the inner peripheral surface of the center opening of the square planar plate 2*d* and the outer peripheral surface of the plunger 5, the magnetic flux Φ5 produced by the reverse current does not extend through the permanent magnet 12 as shown in FIG. 12. It is because the magnetic permeability of the permanent magnet 12 is substantially equal to that of the air. The magnetic flux Φ5 produced by the reverse current passes through a magnetic path having a low magnetic resistance, as shown in FIG. 12. Should the permanent magnet be applied with the reverse magnetic flux continuously for a long time, the demagnetization would be caused. However, according to the present invention, since no reverse magnetic flux is applied to the permanent magnet. The probability of demagnetization becomes less, thereby it is possible to provide an electromagnet having a long use life and a high degree of reliability.

(Embodiment 4)

Explanation will be herein made of a fourth embodiment of the present invention with reference to FIGS. 13 and 14.

In this embodiment, an electromagnet 10 stated in the embodiment 1 to the embodiment 3 is applied in an actuating mechanism for a switching device. FIG. 13 is a lateral sectional view for a three-phase switching device 20 in which the electromagnet 10 stated in the embodiment 2 is applied. Although explanation will be made of the vacuum switching device in this specification, the permanent magnet 10 according to the present invention can be applied in other circuits breakers including a gas switching device. Further, while explanation will be made of such an arrangement that the electromagnet 10 stated in the embodiment 2 is applied, the electromagnet stated in the embodiment 1 or the embodiment 3 may be also applied.

The vacuum switching device 20 is composed of vacuum bulbs 30, an actuating mechanism part 40, an insulator frame 31, a control circuit 51 and a manipulation space 50 for accommodating the electromagnet 10. The vacuum bulbs 30 are arranged for three phases in the depthwise direction of the surface of the figure. Three vacuum bulbs 30 are coupled to one another by a shaft 41 in the operating mechanism 40, and are actuated by the single electromagnet 10.

A vacuum is held in each of the vacuum bulbs 30 by a vacuum container composed of upper and lower end plates 32 and an insulator cylinder 33. A stationary contact 37 and a movable contact 38 are arranged in the vacuum bulb 30, and are adapted to make contact with each other or separate from each other so as to effect turn-on and off operation. The stationary contact 37 is fixed to a stationary conductor 35, and is electrically connected to a stationary side feeder 39. Meanwhile, the movable contact 38 is fixed to a movable conductor 36, and is connected to a movable side feeder 62 through the intermediary of a flexible conductor 61. Bellows 34 are connected at opposite ends to the movable conductor 36 and the end plate 32, respectively. The stationary contact 37 and the movable contact 38 can be made into contact with and be separated from each other while a vacuum condition is maintained by the bellows 34.

The vacuum bulbs 30 and the electromagnet 10 are both coupled to the shaft 41, and accordingly, a drive force produced by the electromagnet 10 is exerted to the movable conductor 36. The movable conductor 36 is electrically insulated from the operating mechanism by the insulator rod 36 by the insulator rod 63, and is coupled to a lever 42 fixed to the shaft 41. The movable iron core 1 in the electromagnet 10 is coupled to a lever 44 by means of the connecting member 9.

Through turn-on operation, a press contact spring 43 and a turn-off spring 45 should be urged simultaneously. The press contact spring applies a press-contact force to the contacts during turn-on operation, and the turn-off spring 45 carries out turn-off operation.

The press contact spring 43 is incorporated in an insulator rod 63. FIG. 14 shows a structure around the press contact spring 43. The movable conductor 36 is fixed to a connecting member 43*b*, and the connecting member 43*b* is coupled to a press contact spring holder 43*a* by means of a pin 43*c*. A hole having a diameter slightly larger than that of the pin 43*c* is formed in the connecting member 43*b*, and an elliptic hole 43*d* is formed in the press contact spring holder 43*a*. During turn-on operation, when the stationary contact 37 and the movable contact 38 are made into contact with each other, the pin 43*c* starts its movement in the elliptic hole 43*d* (downward direction in the figure), so as to continuously compress the press contact spring 43 until the turn-on operation is completed. Meanwhile, the turn-off spring 45 is continuously held between a top plate 46 of the operating mechanism 40 and a plate 47 fixed to the connecting member 9. The turn-off spring 45 is always compressed during turn-on operation.

Explanation will be made of the operation of the switching device 20. When the coil 3 is energized so as to produce the magnetic field Bc shown in FIG. 7, the movable iron core 1 is driven downward by the attracting force FO, and accordingly, the movable conductor 36 is moved upward so that the contacts are turned on. Even though the current to the coil 3 is cut off after completion of the turn-on operation, this condition is maintained by the attracting force of the permanent magnet 12. During turn-off operation, when the coil 3 is energized by a current in a direction reverse to that during turn-on operation, the magnetic field Bm of the permanent magnet is cancelled out, as shown in FIG. 8, so that the attracting force FO is decreased, and accordingly, the movable conductor 36 is driven downward by the force of the turn-off spring 45.

Next, explanation will be made of technical effects and advantages of this embodiment. By applying the electromagnet 10 in the embodiment 1 or 2 in the switching device, a long use life of about 20 years and several times of operation, greater than 10,000 times, can be ensured without demagnetizing the permanent magnet 12 used for holding a turn-on condition. That is, it is possible to provide a switching device having a long use life with a high degree of reliability.

In the above-mentioned fourth embodiment, although explanation has been made of such an arrangement that the switching device device is operated by a single electromagnet, a switching device of a large capacity, which requires a large opening and closing force usually uses a plurality of electromagnets so as to produce a force corresponding to a capacity of a load. In this case, the number of electromagnets having reference dimensions, which have been prepared beforehand, is adjusted in order to produce a desired opening and closing force.

FIGS. 15 and 16 shows switching devices each using four electromagnets, each of which is a plan view illustrating a switching device similar to the switching device shown in FIG. 13 while the top plate 46 of the operating mechanism 40, the insulator frame 31, the control circuit 51, the stationary side feeder 39, the movable side feeder 62 and the like are removed, and which explain how the electromagnets are mounted to the shaft 41.

In the arrangement shown in FIG. 15, vacuum valves 30*a*, 30*b*, 30*c* respectively corresponding to three phase paths are mounted on the shaft 41 by means of levers 42*a*, 42*b*, 42*c*, respectively, and electromagnets 10*a*, 10*b*, 10*c*, 10*d* having one and the same shape, and one and the same specification are coupled to shaft 41 by means of levers 44*a*, 44*b*, 44*c*, 44*d*, respectively. That is, the four electromagnets apply drive forces to the shaft 41, independent from one another.

In the arrangement shown in FIG. 16, the vacuum valves 30*a*, 30*b*, 30*c* are coupled to the shaft 41 in the same way as that of the arrangement shown in FIG. 15, but the electromagnets are coupled to the shaft 41 in a way different from that of the arrangement shown in FIG. 15. Referring to FIG. 16, the levers 44*a*, 44*b* are coupled to the opposite ends of the shaft 14, and a coupling rod 52 for coupling the levers 44*a*, 44*b* with each other, is pivotally connected to the associated ends of the levers 44*a*, 44*b*. The electromagnets 10*a*, 10*b*, 10*c*, 10*d* having one and the same shape, and one and the same specification are coupled to the coupling rod 52, and accordingly, the drive forces of the permanent magnets 10*a*, 10*b*, 10*c*, 10*d* are applied to the shaft 14 through the intermediary of the coupling rod 52 and the levers 44*a*, 44*b*.

Since any of both arrangements uses the electromagnets 10*a*, 10*b*, 10*c*, 10*d* having one and the same shape, and one and the same specification, a switching device mechanism using a plurality of permanent magnets can be provided with a convenient configuration.

With the electromagnet according to the present invention, and with the operating mechanism for a switching device device, using the electromagnet, no reverse magnetic flux is applied to the permanent magnet, and accordingly, it is possible to provide an inexpensive product which is small-sized and which is highly reliable. Further, the gap between the permanent magnet and the movable iron core which moves to and from the permanent magnet can be adjusted, it is possible to provide a product which is inexpensive and which is highly reliable.

What is claimed is:

1. An electromagnet composed of a coil having an upper surface and a lower surface, and an inner peripheral surface, a movable iron core adapted to move on a center axis of the coil, a stationary iron core having an upper end and provided so as to surround the upper and lower surfaces and an outer peripheral surface of the coil, and a power source for applying a current to the coil forwardly and reversely, the movable iron core being moved toward the stationary iron core when the coil is forwardly energized, wherein the stationary iron core includes a stationary core upper member provided so as to cover one axial end of the coil at the upper end of the stationary iron core, and having an inner peripheral surface and an upper surface, a permanent magnet is provided on the upper surface of the stationary core upper member, and the movable iron core is composed of a planar plate member having a surface which is opposed to the upper surface of the stationary core upper member with the permanent magnet intervening therebetween, and a plunger having a distal end part projected from the stationary core upper member and secured to the planar plate which extends above and over the permanent magnet, and having a cylindrical surface opposed to the inner peripheral surface of the coil, the inner peripheral surface of the stationary iron core upper member and the cylindrical surface of the plunger defining therebetween a gap g1 which is smaller than a thickness of the permanent magnet in the axial direction of the coil in order to prevent a magnet flux produced by the coil from passing through the permanent magnet.

2. An electromagnet as set forth in claim 1, wherein when a forward current is applied, a magnetic field in the same direction as that of a magnetic field produced by the permanent magnet is produced so as to effect attraction, but when a reverse current is applied, the magnetic field produced by the permanent magnet is cancelled out so as to effect release operation.

3. An electromagnet as set forth in claim 1, wherein said permanent magnet is selected from a group consisting of a rare earth samarium-cobalt group magnet, a neodymium group magnet, an alnico group magnet and a ferrite group magnet.

* * * * *

UNITED STATES PATENT AND TRADEMARK OFFICE

CERTIFICATE OF CORRECTION

PATENT NO. : 6,940,376 B2
APPLICATION NO. : 10/854167
DATED : September 6, 2005
INVENTOR(S) : Morita et al.

It is certified that error appears in the above-identified patent and that said Letters Patent is hereby corrected as shown below:

On the Title page, Item (73) Assignee: replace "Hitachi, Ltd., Tokyo (JP)" with

--Hitachi, Ltd., Tokyo (JP); Hitachi Engineering & Services, Co., Ltd.,

Hitachi-shi (JP)--.

Signed and Sealed this

Twenty-fifth Day of March, 2008

JON W. DUDAS
*Director of the United States Patent and Trademark Office*